United States Patent [19]

Magerle

[11] 4,055,928

[45] Nov. 1, 1977

[54] CASING BRICK, AND A METHOD AND APPARATUS FOR MAKING THE SAME

[76] Inventor: Otto Magerle, Hausergasse 11, Klagenfurt (Kaernten), Austria

[21] Appl. No.: 676,642

[22] Filed: Apr. 14, 1976

[30] Foreign Application Priority Data

Apr. 18, 1975 Austria ..... 3011/75
May 21, 1975 Austria ..... 3862/75

[51] Int. Cl.[2] ..... E04B 5/04

[52] U.S. Cl. ..... 52/612; 52/606; 52/405; 52/596

[58] Field of Search ..... 52/612, 749, 405, 407, 52/607, 309, 603, 606, 596; 428/310, 425; 264/46.5, 46.6

[56] References Cited

U.S. PATENT DOCUMENTS

| | | | |
|---|---|---|---|
| 1,676,153 | 7/1928 | Palmer | 52/612 |
| 1,861,759 | 6/1932 | Soper, Jr. | 52/606 |
| 2,004,323 | 6/1935 | Hede | 52/612 |
| 2,030,998 | 2/1936 | Mann | 52/612 |
| 2,519,664 | 8/1950 | Klein | 52/606 |
| 3,478,482 | 11/1969 | Weir | 52/606 |
| 3,757,482 | 9/1973 | Haeussler | 52/405 |
| 3,780,484 | 12/1973 | Muse | 52/596 |
| 3,982,369 | 9/1976 | Keleske | 52/612 |
| 3,984,957 | 10/1976 | Piazza | 52/612 |

*Primary Examiner*—Price C. Faw, Jr.
*Assistant Examiner*—Robert C. Farber
*Attorney, Agent, or Firm*—Blanchard, Flynn, Thiel, Boutell & Tanis

[57] ABSTRACT

A casing brick comprising a hollow insulating insert, and a two-part concrete shell which substantially encloses the insert, two projections extending from the insert and positioned between the two parts of the shell and interlocking projections and grooves for connecting the shell and the insert together.

8 Claims, 3 Drawing Figures

CASING BRICK, AND A METHOD AND APPARATUS FOR MAKING THE SAME

FIELD OF THE INVENTION

This invention relates to casing bricks and to methods and apparatus for making the same.

BACKGROUND OF THE INVENTION

The present invention seeks to provide a heat and sound insulating casing brick having a frame-like or hollow insulating insert, that is to say a building brick which serves as permanent shuttering for a supporting core of concrete poured into it, thus permitting the construction of heat and sound insulating walls.

Casing bricks of this type are usually made of light-weight concrete incorporating heat insulating additives, for example wood shavings and other fibrous material, expanded clay, or perlite. It is also known for insulating sheets of synthetic foam material to be applied to the longer sides of the cavity within the insert. All previously known casing bricks, however, have the disadvantage that the shorter side walls form cold bridges extending from outside to inside of a wall formed therefrom.

According to one aspect of the present invention, there is provided a casing brick comprising a hollow insulating insert, and a two-part concrete shell which substantially encloses the insert, two projections extending from the insert and positioned between the two parts of the shell and interlocking projections and grooves for connecting the shell and the insert together.

Owing to the fact that, in one embodiment of the invention, about half the volume of the casing brick consists of expanded plastics material, particularly advantageous heat insulation values are obtained. The shell serves to protect the insert against mechanical damage, to form a strong impact surface, and to take rendering or other covering. Due to the fact that each of the two parts of the shell are separated by the projections extending from the insert, it is possible to arrange that no heat bridge is formed between the inside and outside of a wall built from the casing bricks which is of decisive importance for heat insulation.

According to another aspect of the present invention there is provided a method of making a casing brick comprising the steps of inserting a hollow insulating insert into a hollow mould which is open at opposite ends and has an outer wall part and an inner wall part, the inner wall part forming a lining for the interior of the insert, and pouring concrete mixture into a cavity between the insert and the said outer wall part.

The present invention also seeks to provide an apparatus for making casing building bricks of this type. The manufacture of casing bricks requires particular care, because of the relatively low breaking strength of the insert, particularly if it is of expanded plastics material. This relatively low breaking strength makes it impossible for the insert to be used as shuttering for the casting of the shell unless special precautions are taken. As will be appreciated pressure applied to the insert during casting of the shell would very easily result in the fracture of the insert.

According to a further aspect of the present invention, there is provided an apparatus for making casing bricks comprising a hollow mould consisting of an outer wall body whose dimensions correspond to the outside dimensions of the casing brick which is to be produced, and an inner wall body inserted therein, the inner wall body having a height at least equal to the height of an insulating insert arranged to fit into the interior of the inner wall body to define a cavity between the insert and the outer wall body for the reception of a concrete mixture which, when set, forms a concrete shell substantially enclosing the insert.

Preferably, said inner wall body tapers conically and the insert has internal walls which taper correspondingly.

BRIEF DESCRIPTION OF THE DRAWINGS

The invention is illustrated, merely by way of example, in the accompanying drawings, in which.

DETAILED DESCRIPTION

Figure 1:
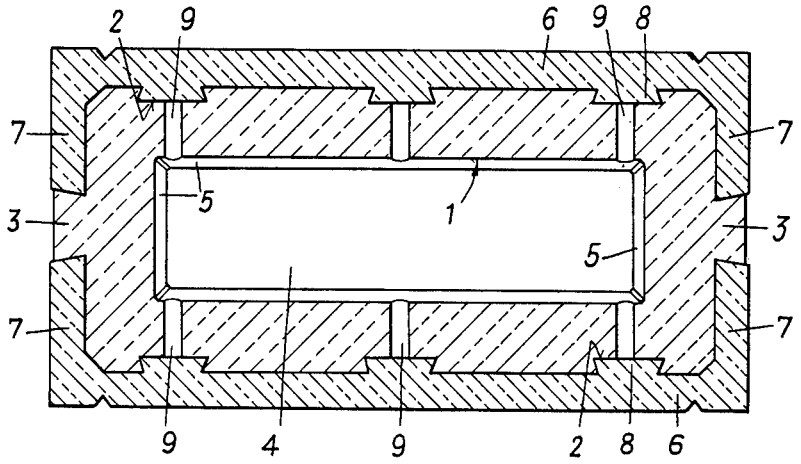
FIG. 1 is a horizontal section through a casing brick according to the present invention.

Referring first to FIG. 1, there is illustrated a casing brick according to the present invention consisting of a hollow insulating insert 1 of expanded plastics material, for example, expanded polystyrene, having the form of a rectangular frame which has a height equal to that of the brick and which on two longitudinal sides has dovetail grooves 2 extending from top to bottom, while, in the middle of the shorter sides, it has projections 3 which likewise extend from top to bottom. A cavity 4 in the middle of the insert 1 is not a perfect right parallelepiped in shape, but tapers in the downward direction, boundary walls 5 of the cavity 4 being slightly inclined in relation to the vertical for the reasons explained hereinafter in relation to the making of the casing brick.

The insert 1 is covered on its exterior by a two-part shell 6 of concrete containing heat insulating additives, for example expanded clay. The shell 6 extends over the entire length of the longer sides of the insert and has angled end portions 7, extending as far as the projections 3 of the insert 1. On the longer sides each part of the shell 6 has dovetail-shaped projections 8 which engage in the corresponding grooves 2 of the insert 1 and fill them completely. Because of the dovetail shape of the grooves 2 and projections 8, the two parts of the shell 6 are positively joined to the part 1. Bores 9 are provided in the insert 1 in the region of the grooves 2, and serve to allow the mixing water in the material forming the shell 6 to evaporate.

This casing brick has a weight which is extremely low in relation to its size (e.g. about 11 kg when its dimensions are 50 × 25 × 25 cm), so that it can easily be handled manually. Moreover, the casing brick has better heat and sound insulation properties than conventional casing bricks made of light-weight concrete. Consequently it is not essential for additional sound or heat insulating cladding to be applied to walls formed from the casing bricks of the present invention.

The two parts of the shell 6 are cast on the insert 1 in one operation, the latter acting as permanent shuttering. One wall part of a casting mould for the shell 6 bears against the walls 5 of the cavity 4 of the insert 1, so that the mould can be inserted and withdrawn without difficulty. This wall part thus lines the cavity 4 and provides support to take inwardly acting pressure which occurs during the casting of the shell 6, and which could not be taken by the material of the insert by itself.

Completed casing bricks are laid one upon the other in courses in the usual manner on a building site, each course being staggered relative to adjacent rows by half the length of a casing brick, and concrete mortar is poured into the cavities 4. After setting, this concrete mortar forms a supporting framework which is continuous through the courses. There is no need for the adjacent surfaces of the individual casing bricks lying to be mortared.

Figure 2:
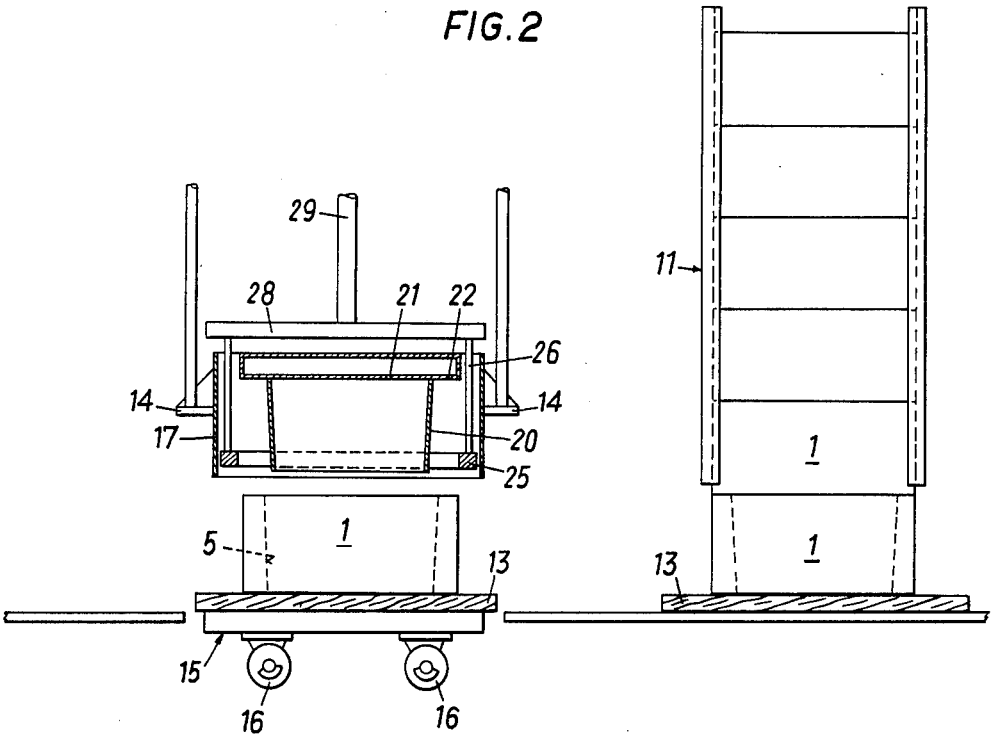
FIG. 2 is an elevational view of an apparatus for making casing bricks according to the present invention.

An apparatus for making casing bricks according to the present invention will be described with reference to FIGS. 2 and 3. A magazine 11 contains a plurality of the inserts 1 stacked one above the other. The lowermost insert 1 rests upon a support plate or board 13 which, by means of a feed device (not shown), can be brought beneath a hollow production mould. The mould can be moved vertically as a whole by means of a hydraulic system acting on brackets 14. In this position the board 13 rests upon a vibrating device 15, which is vibrated by rotation of eccentric discs 16. The mould is open at the bottom and comprises an outer wall body 17 and a frame-like inner wall body 20.

Figure 3:
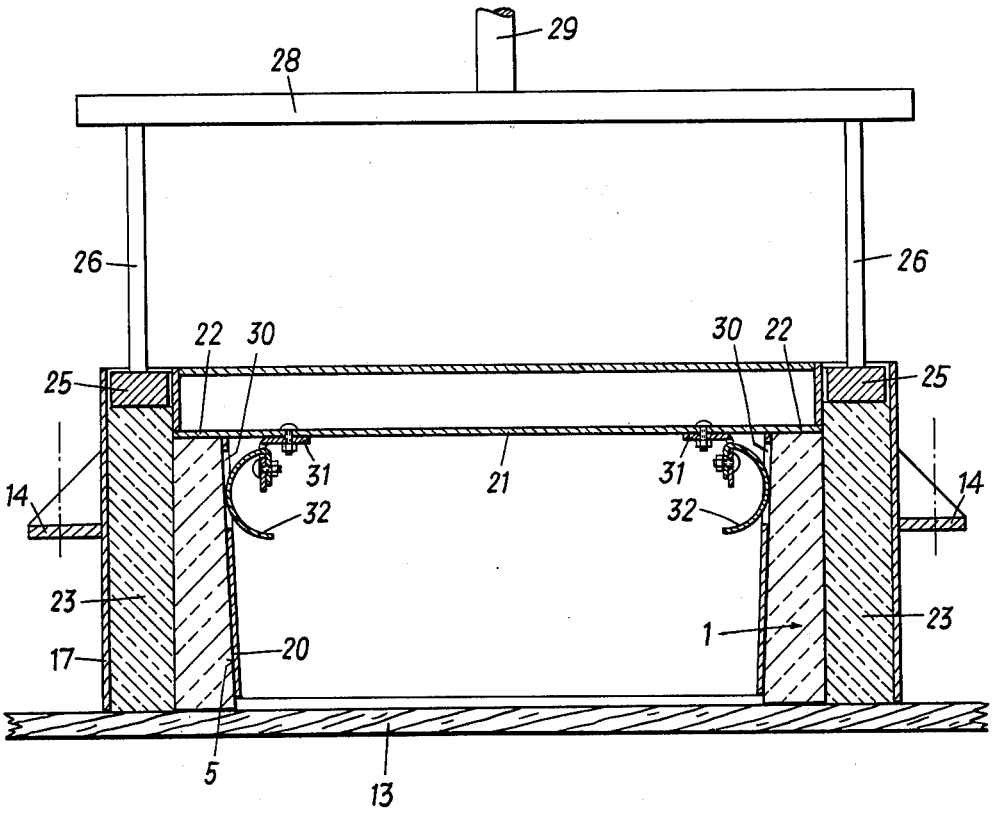
FIG. 3 is a vertical middle section through a hollow mould with a casing brick according to the present invention contained therein.

In order to form the shell 6 the mould is lowered hydraulically from a rest position (shown in FIG. 2) onto the board 13 until the outer wall body 17 engages the latter as shown in FIG. 3. The inner wall body 20 of the mould thus lies against the walls 5 of the cavity 4 of the insert 1. The inner wall body 20 has a slight downward conical taper which matches the taper of the walls 5, so that its insertion into the insert 1 presents no problem. On the upper side of the inner wall body 20, which has approximately the same height as the insert 1, is situated a horizontal closure plate 21 whose edge 22 covers the insert 1 contained in the mould, so that, when viewed in cross-section, the insert 1 is embraced on three sides, namely by the edge 22, the inner wall body 20 of the mould, and the board 13. A concrete mixture 23, which is to form the shell 6, can thus be introduced without difficulty into the cavity defined between the outer wall body 17 and the insert, and can be pressed and compacted in this cavity without causing damage to the insert 1 because it is supported by the inner wall body 20 and so can withstand the applied pressure without risk of breaking.

The concrete mixture 23, mixed with a light-weight additive, for example expanded clay or crushed brick, is introduced from above into the cavity between the outer wall body 17 and the insert 1, and then compressed or compacted by means of a pressing device. This pressing device consists of pressing bars 25 which are connected by rods 26 to a press-beam 28 acted on by a piston rod 29 of a hydraulic cylinder (not shown). Simultaneously with the compaction of the concrete mixture, the vibrating device 15 is set in motion. Obviously only sufficient concrete mixture is introduced into the cavity between the outer wall body 17 and the insert 1 to ensure that, at the end of the compaction and vibrating thereof, it will have the same height as the insert 1, which extends to the edge 22 of the plate 21. When the concrete mixture 23 is poured, it penetrates into the grooves 2 in the insert 1, so that, after setting, a positive connection between the shell 6 and the insert 1 is made.

In the case of an apparatus in which the casing bricks are made on the ground, the latter serving as a support, the insert 1 is brought under the mould on a transportable support, the mould is lowered onto the insert, the transportable support is removed, and the mould containing the insert is placed on the ground, whereupon concrete mixture is poured into the mould. For this purpose an apparatus is required which will secure the insert in the mould after the removal of the transportable support and during placement of the mould containing the insert on the ground. Apparatus of this type is illustrated in FIG. 3.

The inner wall part 20 of the mould is provided, at opposed locations, with slit-like cut-outs 30 and angles 31 are fixed to the plate 21, each angle 31 carrying a leaf spring 32 bent in a bow-shape. Each spring 32 projects into a respective one of the cut-outs 30 and bears resiliently against the inner surface of the insert 1. Since the insert is very light in weight, the friction between it and the springs 32 is sufficient to hold it in place in the mould. The springs 32 do not, however, prevent the mould from being pulled from the finished casing brick because the latter is considerably heavier than just the insert.

A casing brick as described above has the advantage that no cold bridges exist between outside and inside of a wall formed therefrom due to the projections 3, so that a substantially greater insulating effect can be achieved without additional cost being incurred.

The embodiments of the invention in which an exclusive property or privilege is claimed are defined as follows:

1. A casing brick, comprising:

a hollow and unitary insulating insert;

a concrete shell consisting of two separate parts having a spacing therebetween and substantially enclosing said insert, said two separate parts being free of contact over the entire periphery thereof, said insert having two projections thereon received in the spacing between said two parts of said shell; and interlocking means for connecting each shell part to said insert.

2. A casing brick is claimed in claim 1 in which said interlocking means includes dovetail-shaped grooves on said insert engaged by corresponding dovetail-shaped projections on said shell.

3. A casing as claimed in claim 1 in which said insert has internal walls which converge conically in one direction.

4. A casing brick as claimed in claim 1, in which said insert is made of expanded plastics material.

5. A casing brick as claimed in claim 1 in which the insert has a plurality of bores in the region of the grooves.

6. A casing brick as claimed in claim 1 in which said insert has a height equal to that of the brick and said two-part concrete shell is mounted on the sides of said insert, said interlocking means being located between the mutually facing sides of said insert and each of said two-part shell.

7. A casing brick as claimed in claim 1 in which the terminal end of said two projections on said insert are each flush with the exterior surface of said two-part shell.

8. A casing brick as claimed in claim 7 in which said two projections extend in opposed directions from said insert.

* * * * *